US009587527B2

(12) United States Patent
Lichti

(10) Patent No.: US 9,587,527 B2
(45) Date of Patent: Mar. 7, 2017

(54) CAMSHAFT PHASER

(71) Applicant: DELPHI TECHNOLOGIES, INC., Troy, MI (US)

(72) Inventor: Thomas H. Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 37 days.

(21) Appl. No.: 14/532,085

(22) Filed: Nov. 4, 2014

(65) Prior Publication Data

US 2016/0123195 A1 May 5, 2016

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/46*** | (2006.01) |
| ***F04C 2/344*** | (2006.01) |

(52) U.S. Cl.

CPC ..... *F01L 1/3442* (2013.01); *F01L 1/047* (2013.01); *F01L 1/46* (2013.01); *F04C 2/3448* (2013.01); *F01L 2001/34423* (2013.01); *F01L 2001/34426* (2013.01)

(58) Field of Classification Search

CPC ..... F01L 1/047; F01L 1/46; F04C 2/3448
USPC ..... 123/90.17
See application file for complete search history.

(56) References Cited

U.S. PATENT DOCUMENTS

| | | | | |
|---|---|---|---|---|
| 6,814,038 | B2 | 11/2004 | Smith | |
| 6,971,353 | B2 * | 12/2005 | Heinze | F01L 1/022 123/90.15 |
| 7,000,580 | B1 | 2/2006 | Smith et al. | |
| 7,137,371 | B2 | 11/2006 | Simpson et al. | |
| 7,198,013 | B2 | 4/2007 | Palesch et al. | |
| 7,389,756 | B2 | 6/2008 | Hoppe et al. | |
| 7,600,531 | B2 | 10/2009 | Patze et al. | |
| 7,841,310 | B2 * | 11/2010 | Child | F01L 1/3442 123/90.12 |
| 8,684,041 | B2 | 4/2014 | Konias et al. | |
| 8,733,305 | B2 | 5/2014 | Scheidig | |
| 8,733,308 | B2 | 5/2014 | Racklebe et al. | |
| 2009/0133652 | A1 | 5/2009 | Fujyoshi et al. | |

(Continued)

FOREIGN PATENT DOCUMENTS

| | | | |
|---|---|---|---|
| DE | 102008023583 | A1 | 11/2009 |
| DE | 102010005604 | A1 | 7/2011 |

OTHER PUBLICATIONS

U.S. Appl. No. 14/340,758 to Lichti.
EP 15189859 EP Search Report Dated Mar. 1, 2016.

*Primary Examiner* — Zelalem Eshete
(74) *Attorney, Agent, or Firm* — Joshua M. Haines

(57) ABSTRACT

A camshaft phaser includes an input member; an output member defining an advance chamber and a retard chamber with the input member; a valve spool moveable between an advance position and a retard position. The valve spool has a phasing volume and a venting volume defined therein such that the phasing volume is fluidly segregated from the venting volume. The valve spool also has a passage providing fluid communication between the phasing volume and the exterior of the valve spool. Oil is supplied to the advance chamber from the phasing volume through the passage in order to retard the timing of a camshaft and oil is supplied to the retard chamber from the phasing volume through the passage in order to advance the timing of the camshaft.

20 Claims, 12 Drawing Sheets

(56) References Cited

U.S. PATENT DOCUMENTS

| | | | |
|---|---|---|---|
| 2009/0145386 | A1 | 6/2009 | Ushida |
| 2009/0159024 | A1 | 6/2009 | Paul et al. |
| 2013/0206088 | A1 | 8/2013 | Wigsten |

* cited by examiner

CAMSHAFT PHASER

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; and still even more particularly to such a camshaft phaser which includes an oil control valve located centrally therein for controlling the flow of oil used to rotate a rotor of the camshaft phaser relative to a stator of the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. Some camshaft phasers incorporate the phasing oil control valve within a camshaft phaser attachment bolt which is used to secure the camshaft phaser to the camshaft. In order to achieve desired performance, a check valve may be included in the camshaft phaser which prevents oil from being back-fed to the oil source. U.S. Pat. No. 7,389,756 to Hoppe et al. describes one such camshaft phaser. While the arrangement of Hoppe et al. may be effective, implementation of the check valve may add axial length to the phasing oil control valve. Furthermore, complexity may be added to the assembly process due to the need for several small and hard to handle components which make up the check valve.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; and a valve spool moveable between an advance position and a retard position. The valve spool has a valve spool bore with a phasing volume and a venting volume defined within the valve spool bore such that the phasing volume is fluidly segregated from the venting volume. The valve spool also has a spool phasing passage providing fluid communication between the phasing volume and the exterior of the valve spool. Oil is supplied to the advance chamber from the phasing volume through the spool phasing passage in order to retard the timing of the camshaft relative to the crankshaft and oil is supplied to the retard chamber from the phasing volume through the spool phasing passage in order to advance the timing of the camshaft relative to the crankshaft.

A method of using a camshaft phaser is also provided where the camshaft phaser is used with an internal combustion engine for controllably varying the phase relationship between a crankshaft and a camshaft in the internal combustion engine, and where the camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; and a valve spool moveable between an advance position and a retard position, the valve spool having a valve spool bore with a phasing volume and a venting volume defined within the valve spool bore such that the phasing volume is fluidly segregated from the venting volume, and the valve spool also having a spool phasing passage providing fluid communication between the phasing volume and the exterior of the valve spool. The method includes placing the valve spool in the advance position to supply oil to the retard chamber from the phasing volume through the spool phasing passage in order to retard the timing of the camshaft relative to the crankshaft; and placing the valve spool in the retard position to supply oil to the advance chamber from the phasing volume through the spool phasing passage in order to advance the timing of the camshaft relative to the crankshaft.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
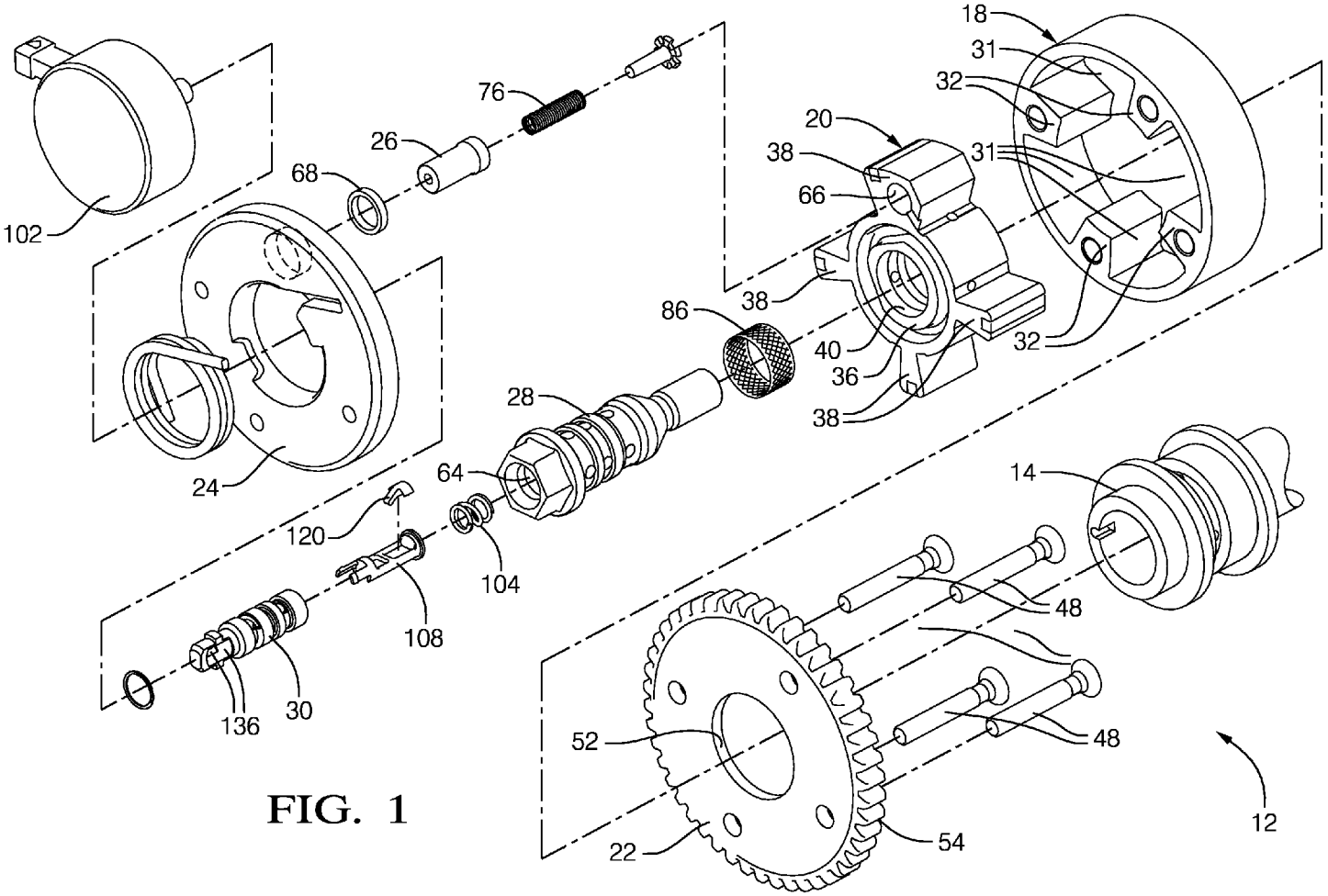
FIG. 1 is an exploded isometric view of a camshaft phaser in accordance with the present invention.

In accordance with a preferred embodiment of this invention and referring to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one end of stator 18, a front cover 24 closing off the other end of stator 18, a lock pin 26, a camshaft phaser attachment bolt 28 for attaching camshaft phaser 12 to camshaft 14, and a valve spool 30. The various elements of camshaft phaser 12 will be described in greater detail in the paragraphs that follow.

Stator 18 is generally cylindrical and includes a plurality of radial chambers 31 defined by a plurality of lobes 32 extending radially inward. In the embodiment shown, there are four lobes 32 defining four radial chambers 31, however, it is to be understood that a different number of lobes 32 may be provided to define radial chambers 31 equal in quantity to the number of lobes 32.

Rotor 20 includes a central hub 36 with a plurality of vanes 38 extending radially outward therefrom and a rotor central through bore 40 extending axially therethrough. The number of vanes 38 is equal to the number of radial chambers 31 provided in stator 18. Rotor 20 is coaxially disposed within stator 18 such that each vane 38 divides each radial chamber 31 into advance chambers 42 and retard chambers 44. The radial tips of lobes 32 are mateable with central hub 36 in order to separate radial chambers 31 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22. Back cover 22 may also include a sprocket 54 formed integrally therewith or otherwise fixed thereto. Sprocket 54 is configured to be driven by a chain that is driven by the crankshaft of internal combustion engine 10. Alternatively, sprocket 54 may be a pulley driven by a belt or any other known drive member known for driving camshaft phaser 12 by the crankshaft. In an alternative arrangement, sprocket 54 may be integrally formed or otherwise attached to stator 18 rather than back cover 22.

Similarly, front cover 24 is sealingly secured, using cover bolts 48, to the axial end of stator 18 that is opposite back cover 22. Cover bolts 48 pass through back cover 22 and stator 18 and threadably engage front cover 24; thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby by clamping rotor 20 securely to camshaft 14. In this way, relative rotation between stator 18 and rotor 20 results in a change is phase or timing between the crankshaft of internal combustion engine 10 and camshaft 14.

Oil is selectively supplied to advance chambers 42 from an oil source 55, for example an oil pump of internal combustion engine 10 which may also provide lubrication to various elements of internal combustion engine 10, in order to cause relative rotation between stator 18 and rotor 20 which results in retarding the timing of camshaft 14 relative to the crankshaft of internal combustion engine 10. When oil is supplied to advance chambers 42 in order to retard the timing of camshaft 14, oil is also vented from retard chambers 44. Conversely, oil is selectively supplied to retard chambers 44 from oil source 55 in order to cause relative rotation between stator 18 and rotor 20 which results in advancing the timing of camshaft 14 relative to the crankshaft of internal combustion engine 10. When oil is supplied to retard chambers 44 in order to advance the timing of camshaft 14, oil is also vented from advance chambers 42. Rotor advance passages 56 may be provided in rotor 20 for supplying and venting oil to and from advance chambers 42 while rotor retard passages 58 may be provided in rotor 20 for supplying and venting oil to and from retard chambers 44. Supplying and venting oil to and from advance chambers 42 and retard chambers 44 is controlled by valve spool 30, as will be described in detail later, such that valve spool 30 is coaxially disposed slidably within a valve bore 64 of camshaft phaser attachment bolt 28 where valve bore 64 is centered about camshaft axis 16.

Lock pin 26 selectively prevents relative rotation between stator 18 and rotor 20 at a predetermined aligned position of rotor 20 within stator 18, which as shown, may be a full advance position, i.e. rotor 20 is rotated as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin 26 through either a first lock pin passage 70 formed in rotor 20 or through a second lock pin passage 72 formed in rotor 20 and front cover 24 as will be discussed in greater detail later. When pressurized oil is supplied to lock pin 26 through first lock pin passage 70, the pressurized oil acts on a lock pin shoulder 74 of lock pin 26, thereby urging lock pin 26 out of lock pin seat 68 and compressing a lock pin spring 76. When pressurized oil is supplied to lock pin 26 through second lock pin passage 72, the pressurized oil acts on a lock pin axial end 78 of lock pin 26 which is selectively received by lock pin seat 68, thereby urging lock pin 26 out of lock pin seat 68 and compressing lock pin spring 76. Conversely, when lock pin 26 is desired to be seated within lock pin seat 68 when internal combustion engine 10 is turned off, the pressurized oil is vented from lock pin axial end 78 through second lock pin passage 72. Consequently, when the pressure of oil supplied by oil source 55 to lock pin shoulder 74 is sufficiently low due to internal combustion engine 10 being turned off, lock pin 26 will be urged toward front cover 24 by lock pin spring 76. In this way, lock pin 26 is seated within lock pin seat 68 by lock pin spring 76 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-10. Camshaft phaser attachment bolt 28 includes bolt supply passages 80 which extend radially outward from valve bore 64 to the outside surface of camshaft phaser attachment bolt 28. Bolt supply passages 80 receive pressurized oil from oil source 55 via an annular oil supply passage 82 formed radially between camshaft phaser attachment bolt 28 and a counter bore of camshaft 14 and also via radial camshaft oil passages 84 of camshaft 14. A filter 86 may circumferentially surround camshaft phaser attachment bolt 28 at bolt supply passages 80 in order to prevent foreign matter that may be present in the oil from reaching valve spool 30.

Camshaft phaser attachment bolt 28 also includes a bolt annular advance groove 90 on the outer periphery of camshaft phaser attachment bolt 28 and bolt advance passages 92 extend radially outward from valve bore 64 to bolt annular advance groove 90. Bolt annular advance groove 90 is spaced axially apart from bolt supply passages 80 in a direction away from camshaft 14 and is aligned with a rotor annular advance groove 94 which extends radially outward from rotor central through bore 40 such that rotor advance passages 56 extend from rotor annular advance groove 94 to advance chambers 42. In this way, fluid communication is provided between valve bore 64 and advance chambers 42. Second lock pin passage 72 is also connected to rotor annular advance groove 94. In this way, fluid communication is provided between valve bore 64 and lock pin axial end 78.

Camshaft phaser attachment bolt 28 also includes a bolt annular retard groove 96 on the outer periphery of camshaft phaser attachment bolt 28 and bolt retard passages 98 extend radially outward from valve bore 64 to bolt annular retard groove 96. Bolt annular retard groove 96 is spaced axially apart from bolt annular advance groove 90 such that bolt annular advance groove 90 is axially between bolt supply passages 80 and bolt annular retard groove 96. Bolt annular retard groove 96 is aligned with a rotor annular retard groove 100 which extends radially outward from rotor central through bore 40 such that rotor retard passages 58 extend from rotor annular retard groove 100 to retard chambers 44. In this way, fluid communication is provided between valve bore 64 and retard chambers 44. First lock pin passage 70 is also connected to rotor annular retard groove 100. In this way, fluid communication is provided between valve bore 64 and lock pin shoulder 74.

Valve spool 30 is moved axially within valve bore 64 of camshaft phaser attachment bolt 28 by an actuator 102 and a valve spring 104 to achieve desired operational states of camshaft phaser 12 by opening and closing bolt advance passages 92 and bolt retard passages 98 as will now be described. Valve spool 30 includes a valve spool bore 106 extending axially thereinto from the end of valve spool 30 that is proximal to camshaft 14. An insert 108 is disposed within valve spool bore 106 such that insert 108 defines a phasing volume 110 and a venting volume 112 such that phasing volume 110 is substantially fluidly segregated from venting volume 112, i.e. phasing volume 110 does not communicate with venting volume 112. By way of non-limiting example only, insert 108 may be net-formed by plastic injection molding and may be easily inserted within valve spool bore 106 from the end of valve spool bore 106 that is proximal to valve spring 104 prior to valve spool 30 being inserted into valve bore 64 of camshaft phaser attachment bolt 28. In this way, phasing volume 110 and venting volume 112 are easily and economically formed.

Valve spool 30 also includes a supply land 114 which is sized to fit within valve bore 64 in a close sliding relationship such that oil is substantially prevented from passing between the interface between supply land 114 and valve bore 64 while allowing valve spool 30 to be displaced axially within valve bore 64 substantially uninhibited.

Valve spool 30 also includes a spool annular supply groove 116 that is axially adjacent to supply land 114. A spool supply passage 118 extends radially inward from spool annular supply groove 116 to phasing volume 110 within valve spool bore 106. A supply check valve 120 is captured between insert 108 and valve spool bore 106 within phasing volume 110 such that phasing check valve 62 is grounded to insert 108 in order to allow oil to enter phasing volume 110 from spool supply passage 118 while substantially preventing oil from exiting phasing volume 110 to spool supply passage 118.

Valve spool 30 also includes an advance land 122 that is axially adjacent to spool annular supply groove 116. Advance land 122 is sized to fit within valve bore 64 in a close sliding relationship such that oil is substantially prevented from passing between the interface between advance land 122 and valve bore 64 while allowing valve spool 30 to be displaced axially within valve bore 64 substantially uninhibited. Advance land 122 is axially divided by a spool first annular vent groove 124 such that a spool vent passage 126 extends radially inward from spool first annular vent groove 124 to venting volume 112 within valve spool bore 106, thereby providing fluid communication between spool first annular vent groove 124 and venting volume 112.

Valve spool 30 also includes a spool annular phasing groove 128 that is axially adjacent to advance land 122. A spool phasing passage 130 extends radially inward from spool annular phasing groove 128 to phasing volume 110 within valve spool bore 106 in order to provide fluid communication between spool annular phasing groove 128 and phasing volume 110. In this way, spool phasing passage 130 provides fluid communication between phasing volume 110 and the exterior surface of valve spool 30.

Valve spool 30 also includes a retard land 132 that is axially adjacent to spool annular phasing groove 128. Retard land 132 is sized to fit within valve bore 64 in a close sliding relationship such that oil is substantially prevented from passing between the interface between retard land 132 and valve bore 64 while allowing valve spool 30 to be displaced axially within valve bore 64 substantially uninhibited.

Valve spool 30 also includes a spool second annular vent groove 134 that is axially adjacent to retard land 132. A pair of opposing spool vent apertures 136 extend radially inward from spool second annular vent groove 134 to venting volume 112 within valve spool bore 106.

Valve spool 30 also includes a vent land 138 that is axially adjacent to spool second annular vent groove 134. Vent land 138 is sized to fit within valve bore 64 in a close sliding relationship, however, spool vent apertures 136 may extend from spool second annular vent groove 134 axially beyond vent land 138. In this way, vent land 138 comprises two distinct segments that are separated by spool vent apertures 136 as may best be seen in FIG. 1.

Figure 5A:
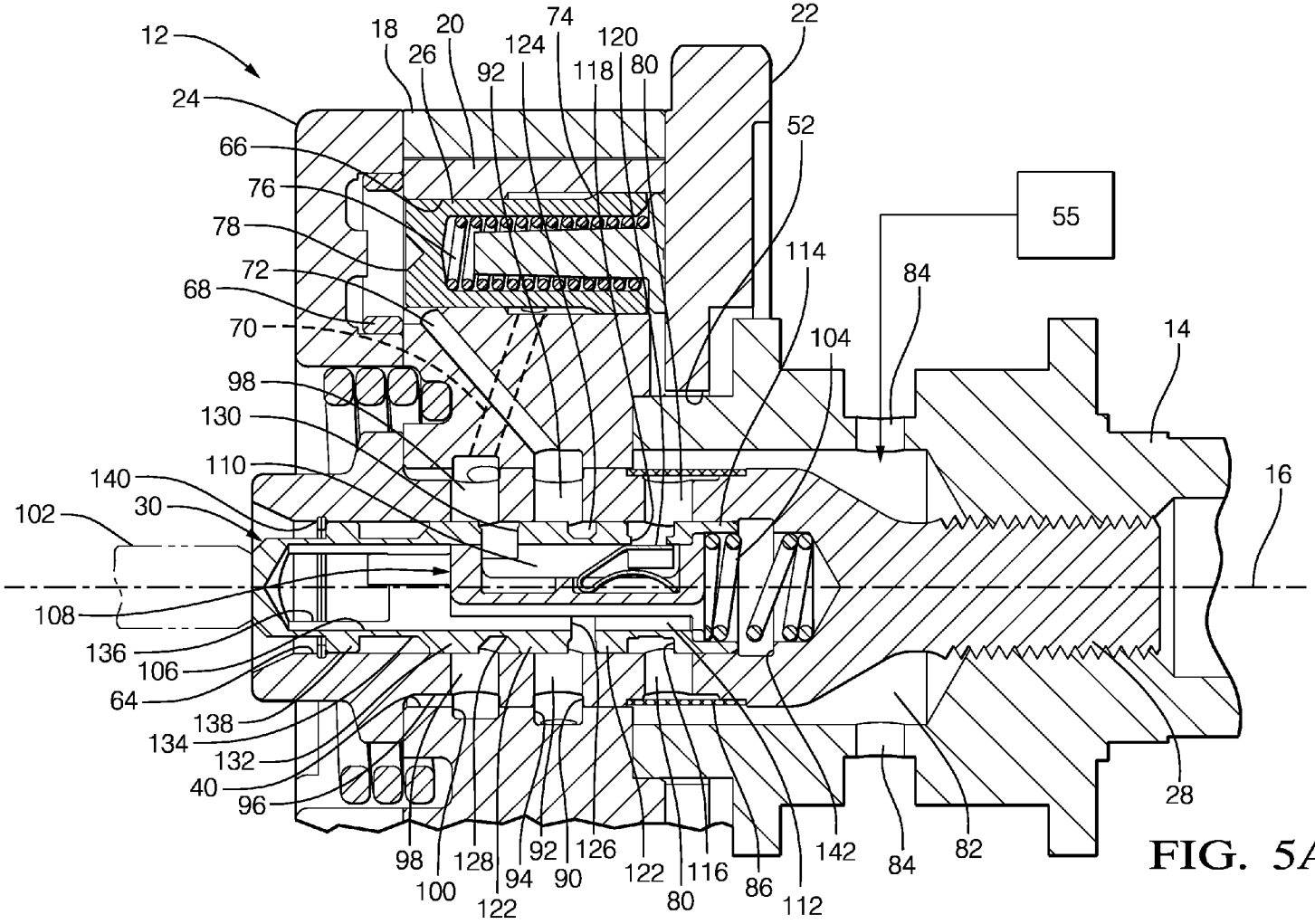
FIG. 5A is an enlarged portion of FIG. 4 showing a valve spool of the camshaft phaser in an advance position.
Figure 5B:
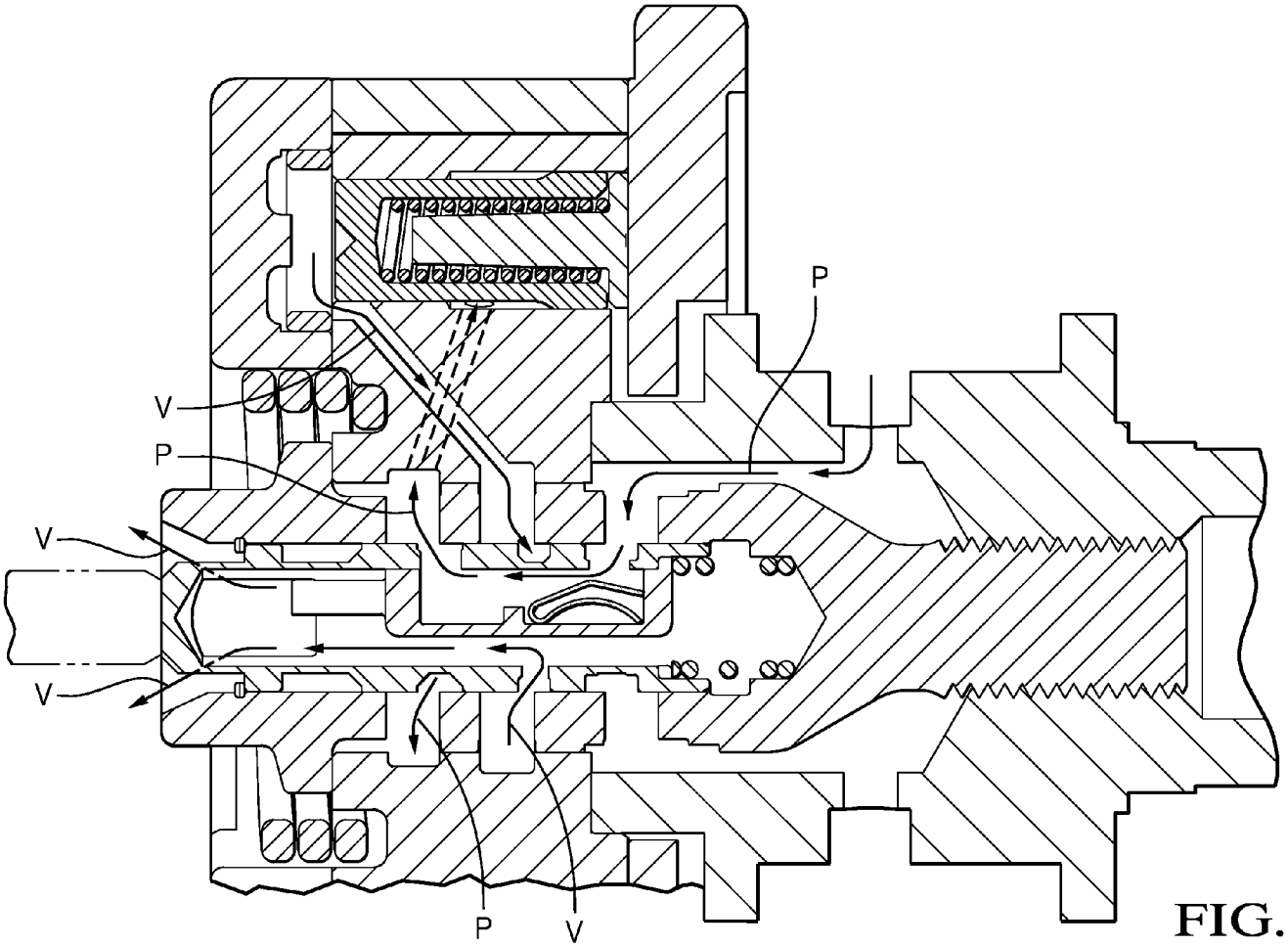
FIG. 5B is the view of FIG. 5A shown with reference numbers removed in order to clearly shown the path of travel of oil.

Actuator 102 may be a solenoid actuator that is selectively energized with an electric current of varying magnitude in order to position valve spool 30 within valve bore 64 at desired axial positions, thereby controlling oil flow to achieve desired operation of camshaft phaser 12. In an advance position, when no electric current is supplied to actuator 102 as shown in FIGS. 5A and 5B, valve spring 104 urges valve spool 30 in a direction toward actuator 102 until vent land 138 of valve spool 30 axially abuts a first stop member 140, which may be, by way of non-limiting example only, a snap ring within a snap ring groove extending radially outward from valve bore 64. In the advance position, supply land 114 is positioned to allow pressurized oil to be supplied to phasing volume 110 through bolt supply passages 80 and supply check valve 120 from oil source 55 when pressure within phasing volume 110 is lower than the pressure of oil source 55. Also in the advance position, advance land 122 is positioned to align spool first annular vent groove 124 with bolt advance passages 92, thereby allowing oil to be vented from lock pin axial end 78 via second lock pin passage 72, rotor annular advance groove 94, bolt annular advance groove 90, bolt advance passages 92, spool first annular vent groove 124, spool vent passage 126, venting volume 112, and spool vent apertures 136 and also thereby allowing oil to be vented from advance chambers 42 via rotor advance passages 56, rotor annular advance groove 94, bolt annular advance groove 90, bolt advance passages 92, spool first annular vent groove 124, spool vent passage 126, venting volume 112, and spool vent apertures 136. From spool vent apertures 136, the oil is vented from the end of valve bore 64 that is proximal to actuator 102. Also in the advance position, advance land 122 blocks fluid communication between bolt advance passages 92 and phasing volume 110. Also in the advance position, retard land 132 is positioned to permit fluid communication between bolt retard passages 98 and phasing volume 110, thereby allowing pressurized oil to be supplied to retard chambers 44 from phasing volume 110 via spool phasing passage 130, spool annular phasing groove 128, bolt retard passages 98, bolt annular retard groove 96, rotor annular retard groove 100, and rotor retard passages 58 and also thereby allowing pressurized oil to be supplied to lock pin shoulder 74, from phasing volume 110 via spool phasing passage 130, spool annular phasing groove 128, bolt retard passages 98, bolt annular retard groove 96, rotor annular retard groove 100, and first lock pin passage 70. Also in the advance position, retard land 132 blocks fluid communication between bolt retard passages 98 and spool second annular vent groove 134. Consequently, in the advance position, pressurized oil from oil source 55 retracts lock pin 26 from lock pin seat 68 and causes rotor 20 to rotate relative to stator 18 to cause an advance in timing of camshaft 14 relative to the crankshaft. In FIG. 5B, the reference numbers have been removed for clarity and arrows representing the path of travel of the oil have been included where arrows P represent pressurized oil from oil source 55 supplied to retard chambers 44 and lock pin shoulder 74 while arrows V represent vented oil from lock pin axial end 78 and advance chambers 42. It should be noted that FIG. 5B shows supply check valve 120 being opened, but supply check valve 120 may also be closed if the pressure within phasing volume 110 rises above the pressure of oil source 55, for example, due to torque reversals of camshaft 14.

Figure 6A:
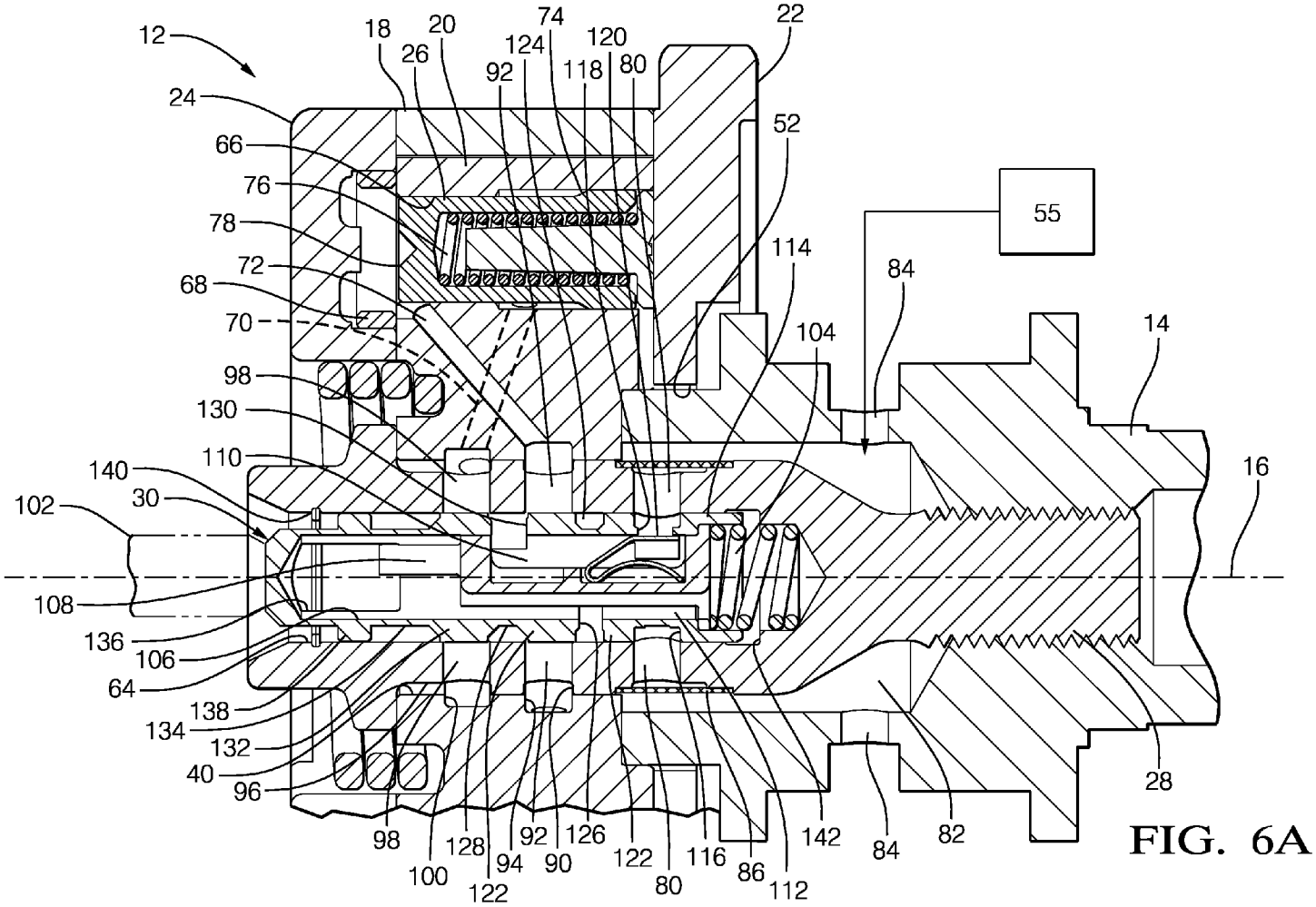
FIG. 6A is the view of FIG. 5A now shown with the valve spool in a hold position.
Figure 6B:
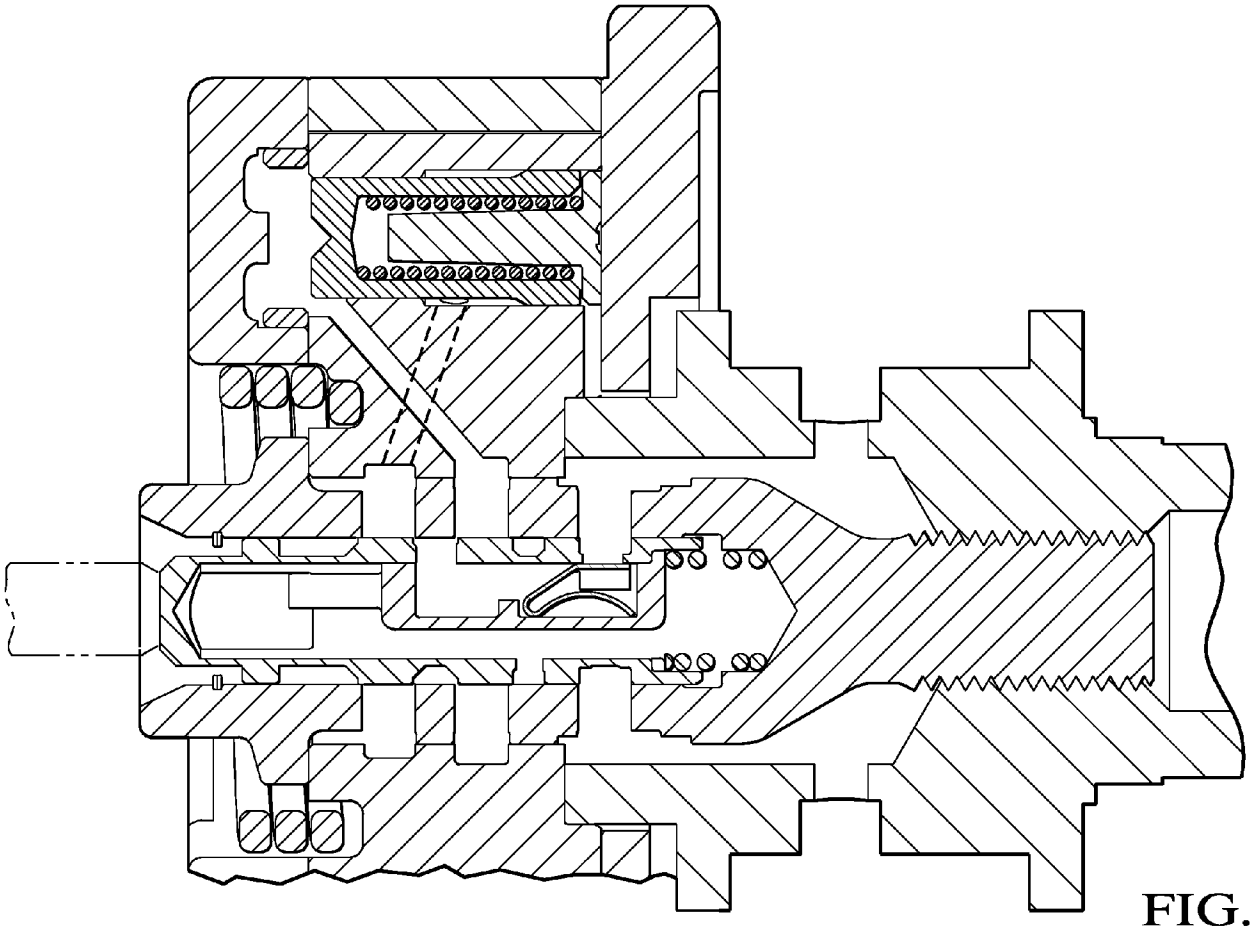
FIG. 6B is the view of FIG. 6A shown with reference numbers removed for clarity.

In a hold position, when an electric current of a first magnitude is supplied to actuator 102 as shown in FIGS. 6A and 6B, actuator 102 urges valve spool 30 in a direction toward valve spring 104 thereby causing valve spring 104 to be compressed slightly. In the hold position, supply land 114 remains positioned to allow pressurized oil to be supplied to phasing volume 110 through bolt supply passages 80 and supply check valve 120 from oil source 55 when pressure within phasing volume 110 is lower than the pressure of oil source 55. Also in the hold position, advance land 122 is positioned to provide restricted fluid communication between bolt advance passages 92 and phasing volume 110 while blocking fluid communication between bolt advance passages 92 and venting volume 112. Also in the hold position, retard land 132 is positioned to provide restricted fluid communication between bolt retard passages 98 and phasing volume 110 while blocking fluid communication between bolt retard passages 98 and spool second annular vent groove 134. By providing restricted fluid communication between bolt advance passages 92 and phasing volume 110 and restricted fluid communication between bolt retard passages 98 and phasing volume 110, the rotational position of rotor 20 relative to stator 18 is substantially maintained in the hold position. In FIG. 6B, the reference numbers have been removed for clarity, and since there is substantially no movement of rotor 20 relative stator 18 and consequently substantially no flow of oil, no arrows have been provided to illustrate the lack of flow of oil.

Figure 7A:
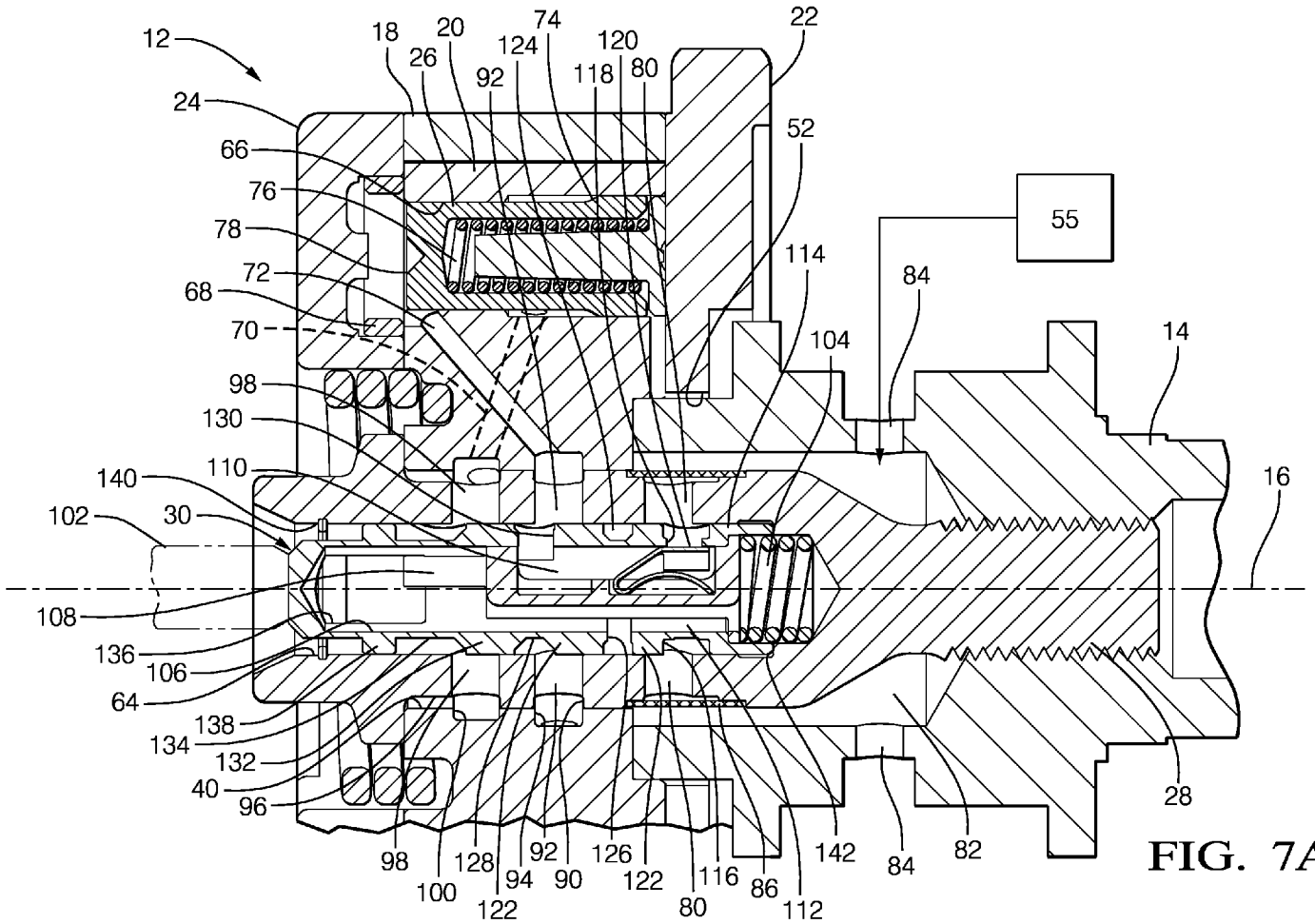
FIG. 7A is the view of FIG. 5A now shown with the valve spool in a retard position.
Figure 7B:
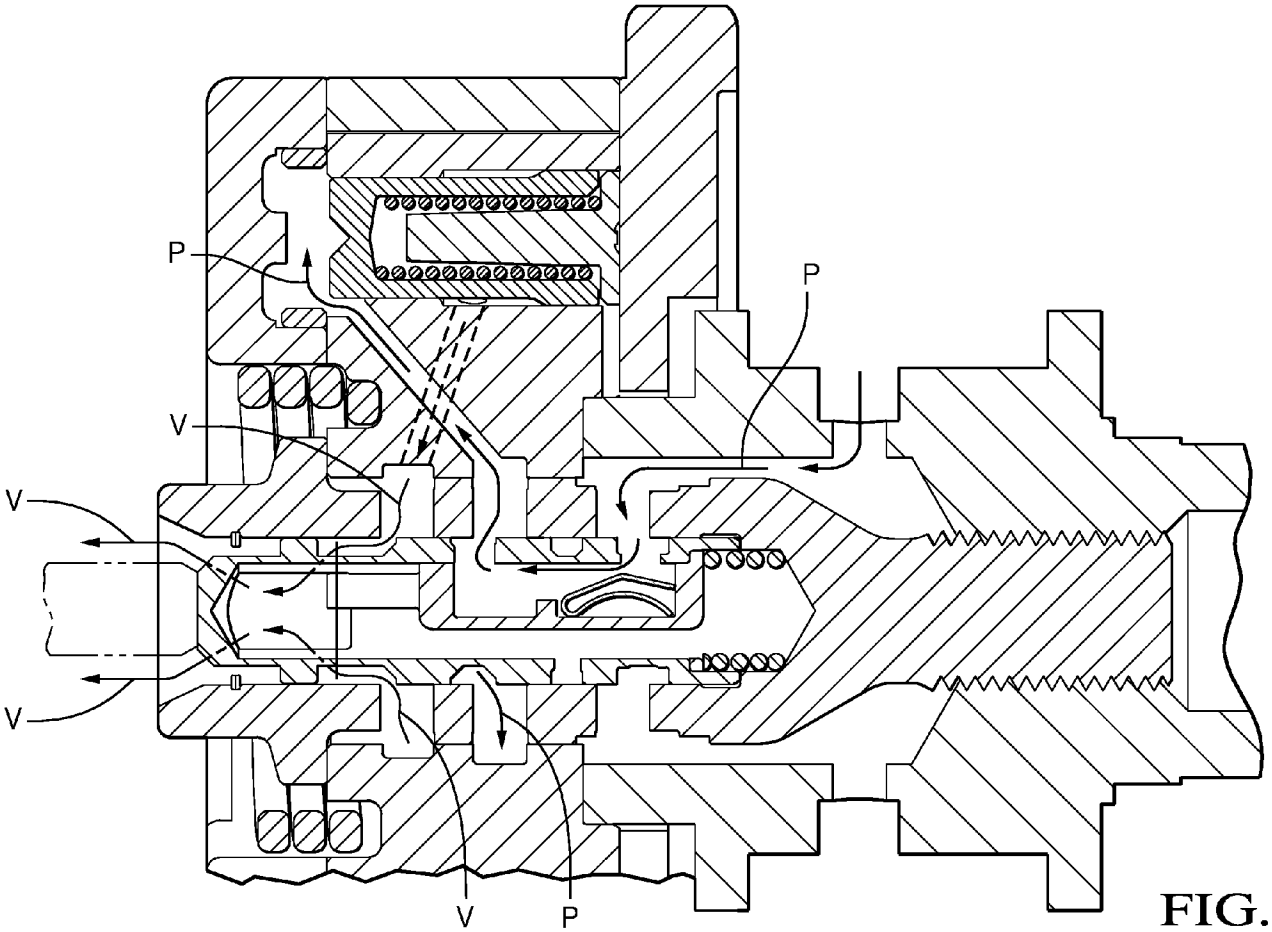
FIG. 7B is the view of FIG. 7A shown with reference numbers removed and arrows added in order to clearly shown the path of travel of oil.

In a retard position, when an electric current of a second magnitude is supplied to actuator 102 as shown in FIGS. 7A and 7B, actuator 102 urges valve spool 30 in a direction toward valve spring 104 thereby causing valve spring 104 to be compressed slightly more than in the hold position until valve spool 30 abuts a second stop member 142, which may be, by way of non-limiting example only, a shoulder formed in valve bore 64. In the retard position, supply land 114 remains positioned to allow pressurized oil to be supplied to phasing volume 110 through bolt supply passages 80 and supply check valve 120 from oil source 55 when pressure within phasing volume 110 is lower than the pressure of oil source 55. Also in the retard position, advance land 122 is positioned to block fluid communication between bolt advance passages 92 and spool first annular vent groove 124 while aligning spool annular phasing groove 128 with bolt advance passages 92, thereby allowing pressurized oil to be supplied to advance chambers 42 from phasing volume 110 via spool phasing passage 130, spool annular phasing groove 128, bolt advance passages 92, bolt annular advance groove 90, rotor annular advance groove 94, and rotor advance passages 56 and also thereby allowing pressurized oil to be supplied to lock pin axial end 78 from phasing volume 110 via spool phasing passage 130, spool annular phasing groove 128, bolt advance passages 92, bolt annular advance groove 90, rotor annular advance groove 94, and second lock pin passage 72. Also in the retard position, retard land 132 is positioned to block fluid communication between bolt retard passages 98 and phasing volume 110, thereby preventing pressurized oil from being to be supplied to retard chambers 44 from phasing volume 110. Also in the retard position, retard land 132 is positioned to align spool second annular vent groove 134 with bolt retard passages 98, thereby allowing oil to be vented from retard chambers 44 to spool vent apertures 136 via rotor retard passages 58, rotor annular retard groove 100, bolt annular retard groove 96, bolt retard passages 98, and spool second annular vent groove 134 and also thereby allowing oil to be vented from lock pin shoulder 74 to spool vent apertures 136 via first lock pin passage 70, rotor annular retard groove 100, bolt annular retard groove 96, bolt retard passages 98, and spool second annular vent groove 134. From spool vent apertures 136, the oil is vented from the end of valve bore 64 that is proximal to actuator 102. Consequently, in the retard position, pressurized oil from oil source 55 retracts lock pin 26 from lock pin seat 68 and causes rotor 20 to rotate relative to stator 18 to cause a retard in timing of camshaft 14 relative to the crankshaft. In FIG. 7B, the reference numbers have been removed for clarity and arrows representing the path of travel of the oil have been included where arrows P represent pressurized oil from oil source 55 supplied to advance chambers 42 and lock pin axial end 78 while arrows V represent vented oil from lock pin shoulder 74 and retard chambers 44. It should be noted that FIG. 7B shows supply check valve 120 being opened, but supply check valve 120 may also be closed if the pressure within phasing volume 110 rises above the pressure of oil source 55, for example, due to torque reversals of camshaft 14.

It should be noted that by supplying oil to lock pin shoulder 74 and lock pin axial end 78 from phasing volume 110, a separate dedicated supply for retracting lock pin 26 from lock pin seat 68 is not required.

As shown in the figures, supply check valve 120 may be a simple one piece device that is made of formed sheet metal that is resilient and compliant and captured between insert 108 and valve spool bore 106. It should also now be understood that supply check valve 120 may take numerous other forms known in the art of check valves and may include multiple elements such as coil compression springs and balls.

Figure 8:
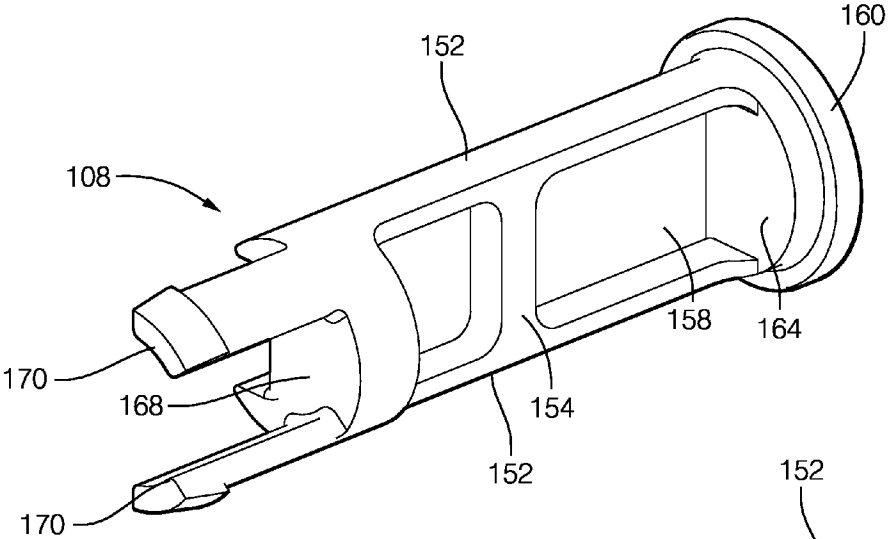
FIGS. 8 and 9 are isometric views of an insert of a valve spool of the camshaft phaser in accordance with the present invention.
Figure 9:
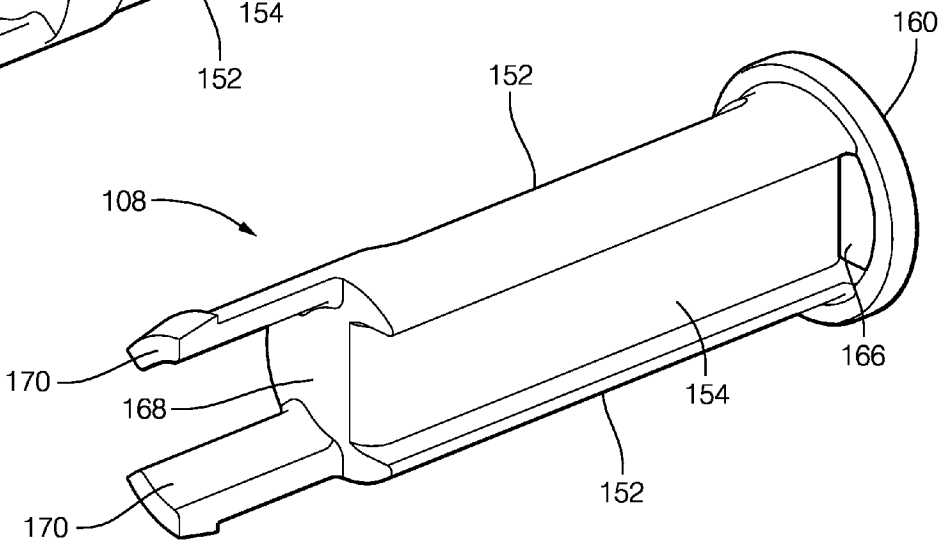
Figure 10:
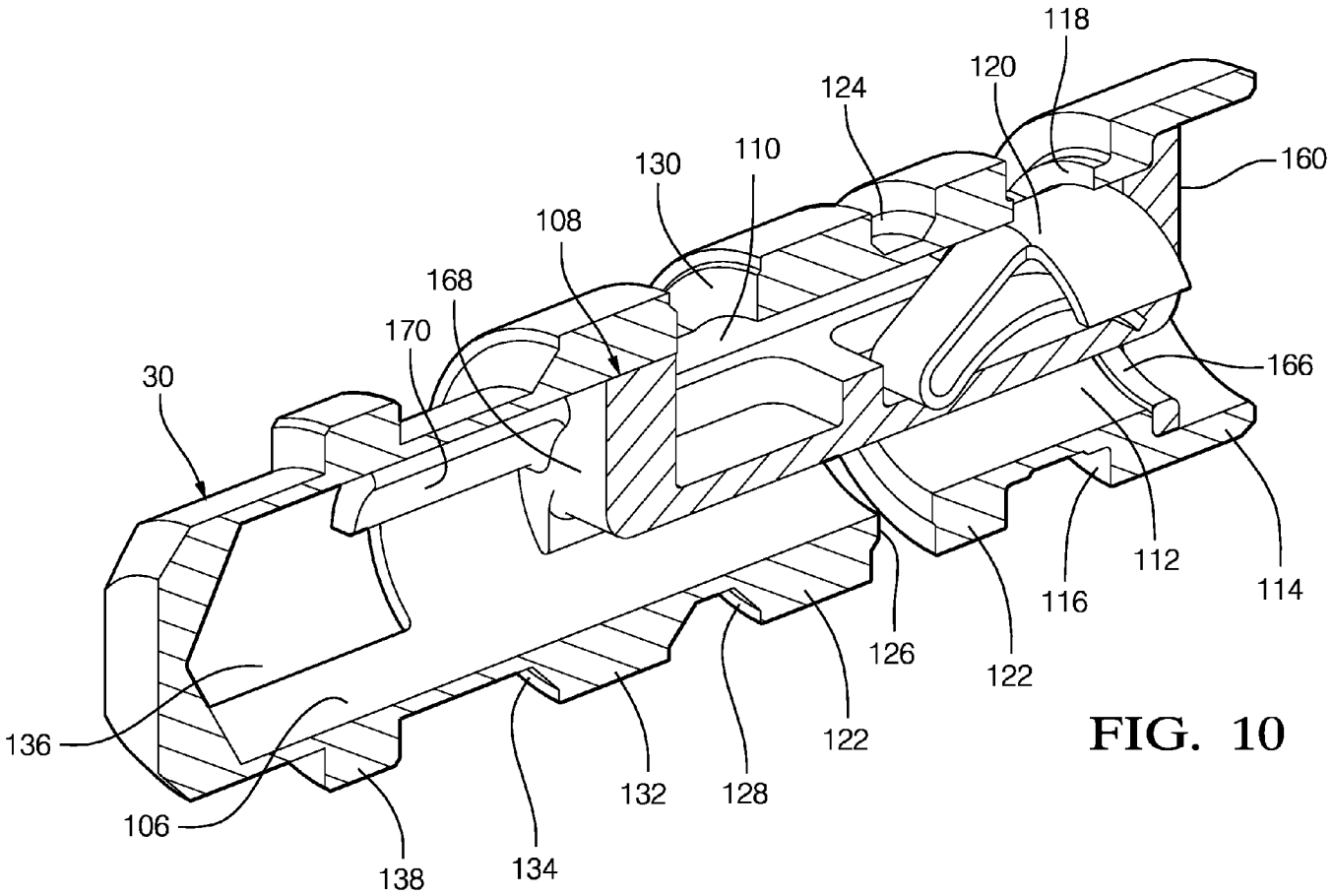
FIG. 10 is an isometric axial cross-sectional view of the valve spool and the insert of the camshaft phaser in accordance with the present invention.

Insert 108 will now be describe with additional reference to FIGS. 8-10 where FIGS. 8 and 9 are isometric views of insert 108 and FIG. 10 is an isometric axial cross-sectional view of valve spool 30 and insert 108. Insert 108 includes a pair of opposing insert sidewalls 152 which extend axially within valve spool bore 106. Insert sidewalls 152 are contoured to conform to valve spool bore 106 and are spaced apart to allow insert sidewalls 152 to sealingly engage valve spool bore 106 to substantially prevent oil from passing between the interface of insert sidewalls 152 and valve spool bore 106. An insert dividing wall 154 traverses insert sidewalls 152 such that one side of insert dividing wall 154 is laterally offset from valve spool bore 106 and faces toward phasing volume 110 while the other side of insert dividing wall 154 is laterally offset from valve spool bore 106 and faces toward venting volume 112. A supply check valve pocket 158 may be defined within the side of insert dividing wall 154 that faces toward phasing volume 110 in order to receive a portion of supply check valve 120, thereby positively positioning supply check valve 120 within phasing volume 110. One end of insert sidewalls 152 terminates at a circular insert base 160 which is received within a valve spool counter bore 162 of valve spool bore 106. An insert base end wall 164 is defined between insert base 160 and insert dividing wall 154 to close off one end of phasing volume 110 while an insert base passage 166 is defined between insert base 160 and insert dividing wall 154 to open venting volume 112 to the portion of valve bore 64 that contains valve spring 104 in order to provide a vent path for any oil that may leak thereinto. Insert base 160 may also serve as a spring seat to valve spring 104. An insert end wall 168 is defined at the other end of insert sidewalls 152 in order to close off the other end of phasing volume 110. It should be noted that insert end wall 168 keeps venting volume 112 open to spool vent apertures 136. A pair of insert retention members 170 may extend axially from insert end wall 168 to snap over and engage spool vent apertures 136 in order to axially retain insert 108 and also to radially orient insert 108 within valve spool bore 106. Alternatively, insert retention members 170 may be omitted because valve spring 104 may be sufficient to retain insert 108 within valve spool bore 106. In the case that insert retention members 170 are omitted, other features may be needed to radially orient insert 108 within valve spool bore 106.

Figure 2:
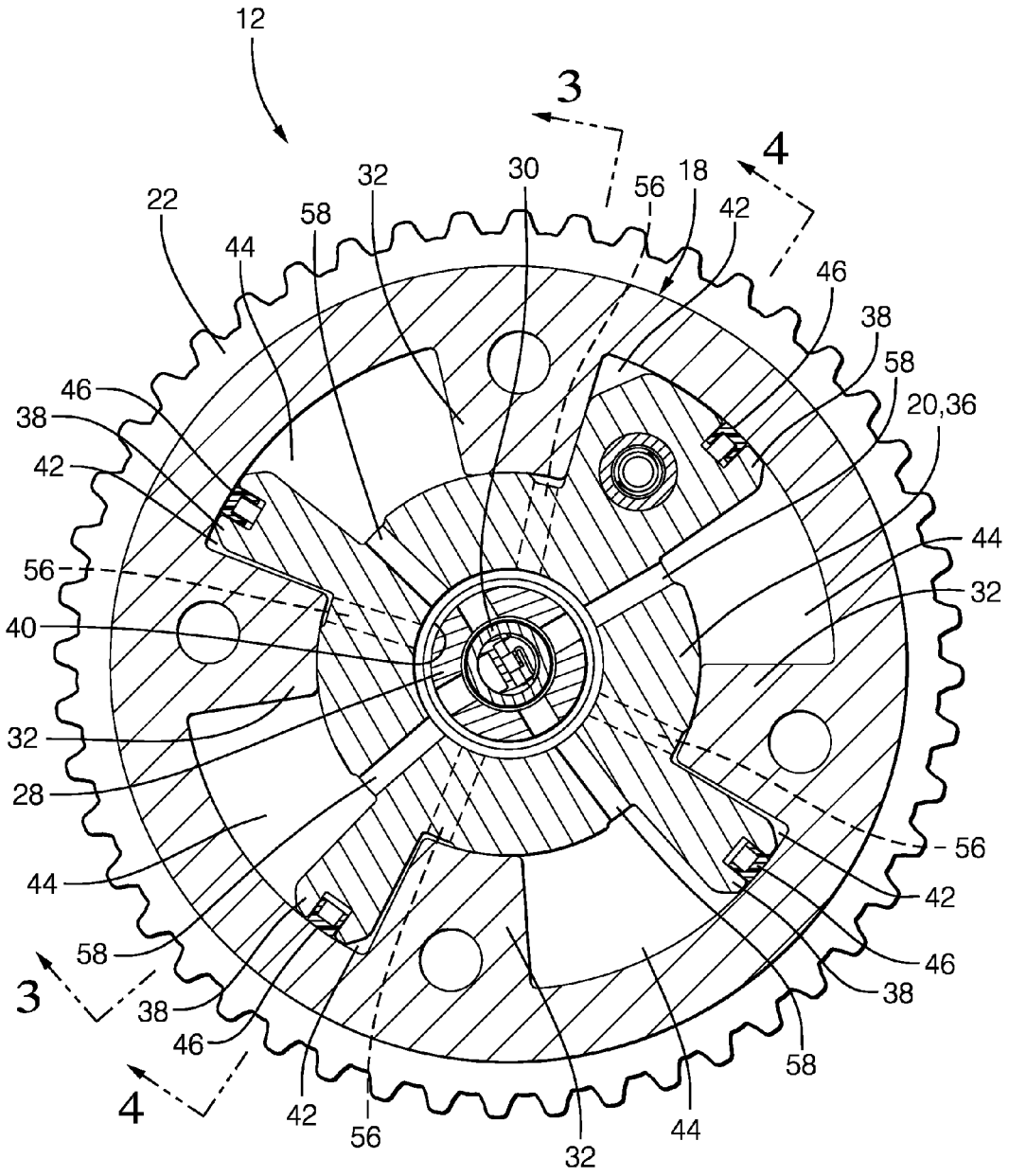
FIG. 2 is a radial cross-sectional view of the camshaft phaser in accordance with the present invention.
Figure 3:
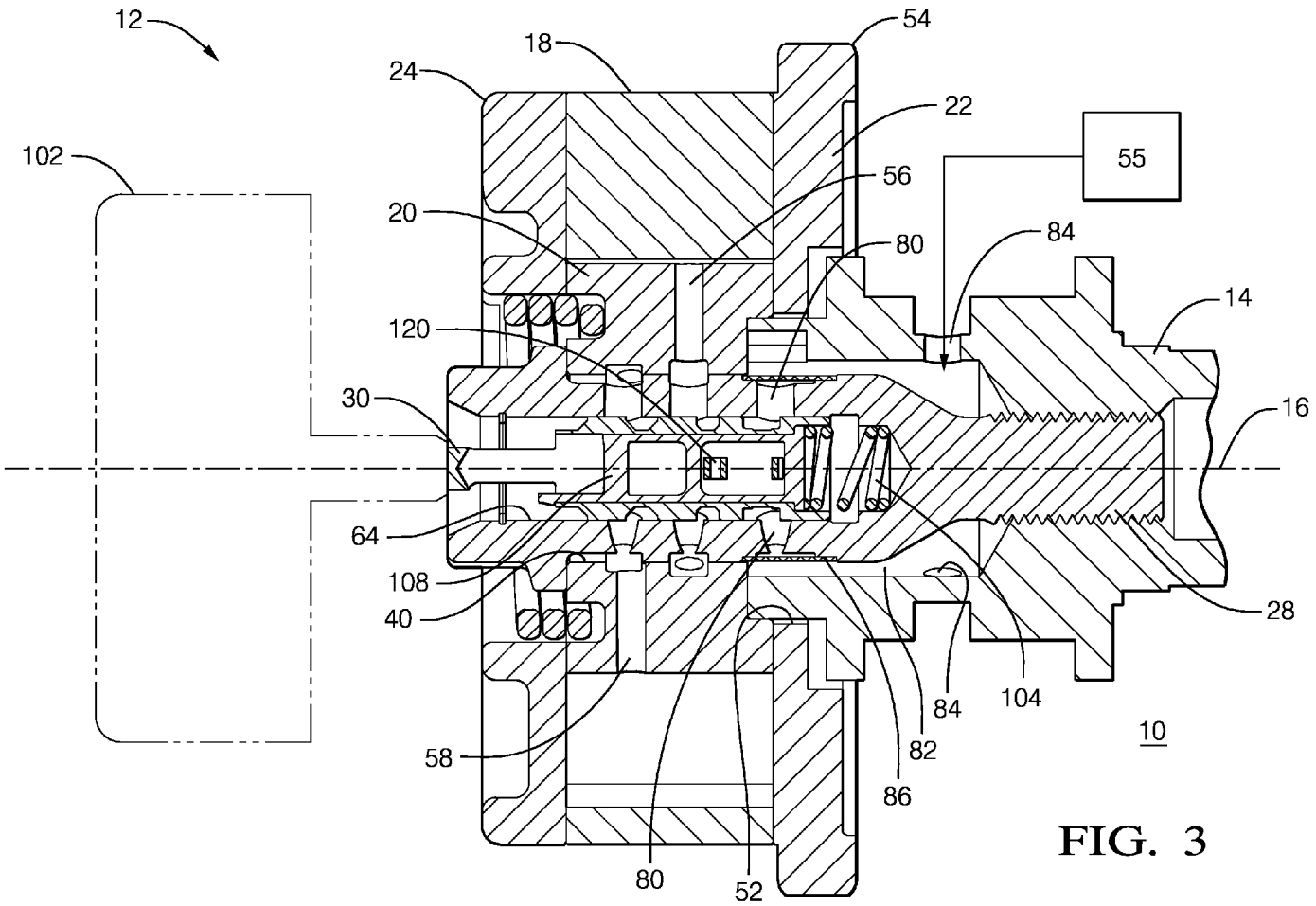
FIG. 3. is an axial cross-sectional view of the camshaft phaser in accordance with the present invention taken through advance and retard passages of a rotor of the camshaft phaser as identified by section line 3-3 in FIG. 2.
Figure 4:
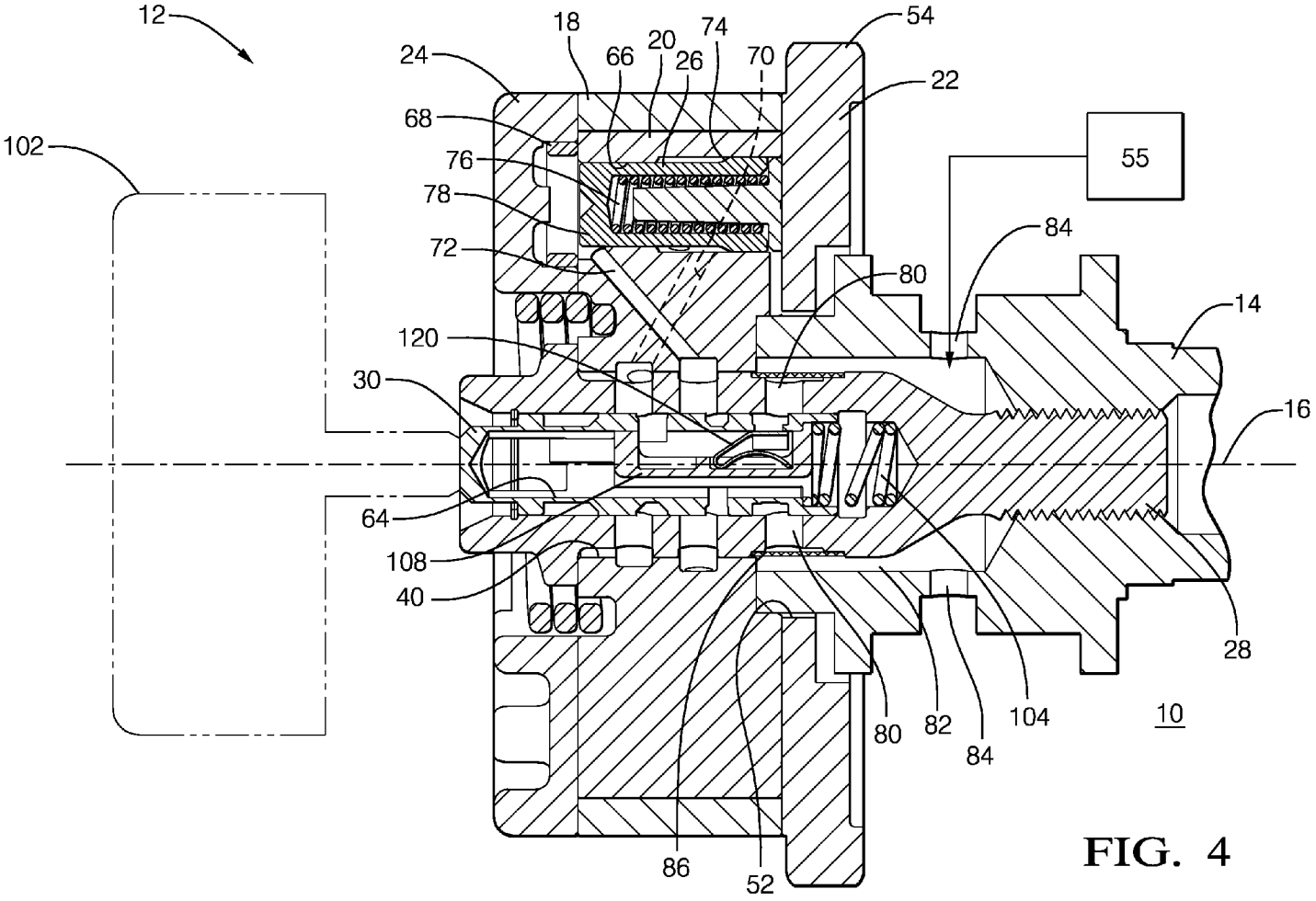
FIG. 4. is an axial cross-sectional view of the camshaft phaser in accordance with the present invention taken through a lock pin of the camshaft phaser as identified by section line 4-4 in FIG. 2.

While camshaft phaser 12 has been described as defaulting to full advance, it should now be understood that camshaft phaser 12 may alternatively default to full retard by simply rearranging oil passages. Similarly, while full advance has been described as full counterclockwise rotation of rotor 20 within stator 18 as shown in FIG. 2, it should also now be understood that full advance may alternatively be full clockwise rotation of rotor 20 within stator 18 depending on whether camshaft phaser 12 is mounted to the front of internal combustion engine 10 (shown in the figures) or to the rear of internal combustion engine 10.

While camshaft phaser attachment bolt 28 has been described herein as including grooves on the outer periphery thereof which are aligned with corresponding grooves formed in rotor central through bore 40 of rotor 20, it should now be understood that the grooves on camshaft phaser attachment bolt 28 could be omitted and the grooves formed in rotor central through bore 40 could be used to serve the same function. Similarly, the grooves formed in rotor central through bore 40 could be omitted and the grooves on camshaft phaser attachment bolt 28 could be used to serve the same function.

Valve spool 30 and insert 108 as described herein allows for simplified construction and assembly of camshaft phaser 12 compared to the prior art. Furthermore, supplying oil to lock pin 26 from phasing volume 110 eliminates the need for an additional groove in valve spool 30 and an additional groove between camshaft phaser attachment bolt 28 and rotor central through bore 40 to create a separate supply for lock pin 26.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member; and a valve spool moveable between an advance position and a retard position, said valve spool having a valve spool bore with a phasing volume and a venting volume defined within said valve spool bore such that said phasing volume is fluidly segregated from said venting volume, and said valve spool also having a spool phasing passage providing fluid communication between said phasing volume and the exterior of said valve spool;

wherein oil is supplied to said advance chamber from said phasing volume through said spool phasing passage in order to retard the timing of said camshaft relative to said crankshaft; and wherein oil is supplied to said retard chamber from said phasing volume through said spool phasing passage in order to advance the timing of said camshaft relative to said crankshaft.

2. A camshaft phaser as in claim 1 further comprising a camshaft phaser attachment bolt for attaching said camshaft phaser to said camshaft wherein said camshaft phaser includes a valve bore within which said valve spool is slidably disposed.

3. A camshaft phaser as in claim 1 wherein said phasing volume and said venting volume are defined by an insert that is disposed within said valve spool bore.

4. A camshaft phaser as in claim 1 further comprising:

a supply passage in fluid communication with an oil source of said internal combustion engine which supplies pressurized oil to said phasing volume; and a supply check valve which prevents oil from flowing from said phasing volume to said supply passage.

5. A camshaft phaser as in claim 4 wherein said supply check valve is located within said phasing volume.

6. A camshaft phaser as in claim 1 further comprising a lock pin which selectively engages a lock pin seat, wherein pressurized oil supplied to said lock pin causes said lock pin to retract from said lock pin seat to permit relative movement between said input member and said output member and wherein venting oil from said lock pin allows said lock pin to engage said lock pin seat in order to prevent relative motion between said input member and said output member at a predetermined aligned position.

7. A camshaft phaser as in claim 6 wherein said advance position and said retard position allow pressurized oil to be supplied to said lock pin.

8. A camshaft phaser as in claim 7 wherein said advance position and said retard position allow pressurized oil to be supplied to said lock pin from said phasing volume.

9. A camshaft phaser as in claim 1 wherein:

supplying oil to one of said advance chamber and said retard chamber causes oil to be vented from the other of said advance chamber and said retard chamber; and said oil is vented through said venting volume.

10. A method of using a camshaft phaser for use with an internal combustion engine for controllably varying the phase relationship between a crankshaft and a camshaft in said internal combustion engine, said camshaft phaser comprising an input member connectable to said crankshaft of said internal combustion engine to provide a fixed ratio of rotation between said input member and said crankshaft; an output member connectable to said camshaft of said internal combustion engine and defining an advance chamber and a retard chamber with said input member; and a valve spool moveable between an advance position and a retard position, said valve spool having a valve spool bore with a phasing volume and a venting volume defined within said valve spool bore such that said phasing volume is fluidly segregated from said venting volume, and said valve spool also having a spool phasing passage providing fluid communication between said phasing volume and the exterior of said valve spool; said method comprising:

placing said valve spool in said advance position to supply oil to said retard chamber from said phasing volume through said spool phasing passage in order to retard the timing of said camshaft relative to said crankshaft; and placing said valve spool in said retard position to supply oil to said advance chamber from said phasing volume through said spool phasing passage in order to advance the timing of said camshaft relative to said crankshaft.

11. A method as in claim 10 wherein supplying oil to one of said advance chamber and said retard chamber causes oil to be vented from the other of said advance chamber and said retard chamber, said method further comprising venting oil from said other of said advance chamber and said retard chamber through said venting volume.

12. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said lobes defining a plurality of alternating advance chambers and retard chambers; and a valve spool moveable between an advance position and a retard position, said valve spool having a valve spool bore with a phasing volume and a venting volume defined within said valve spool bore such that said phasing volume is fluidly segregated from said venting volume, and said valve spool also having a spool phasing passage providing fluid communication between said phasing volume and the exterior of said valve spool;

wherein oil is supplied to said advance chambers from said phasing volume through said spool phasing passage in order to retard the timing of said camshaft relative to said crankshaft; and wherein oil is supplied to said retard chambers from said phasing volume through said spool phasing passage in order to advance the timing of said camshaft relative to said crankshaft.

13. A camshaft phaser as in claim 12 further comprising a camshaft phaser attachment bolt for attaching said camshaft phaser to said camshaft wherein said camshaft phaser includes a valve bore within which said valve spool is slidably disposed.

14. A camshaft phaser as in claim 12 wherein said phasing volume and said venting volume are defined by an insert that is disposed within said valve spool bore.

15. A camshaft phaser as in claim 12 further comprising:

a supply passage in fluid communication with an oil source of said internal combustion engine which supplies pressurized oil to said phasing volume; and a supply check valve which prevents oil from flowing from said phasing volume to said supply passage.

16. A camshaft phaser as in claim 15 wherein said supply check valve is located within said phasing volume.

17. A camshaft phaser as in claim 12 further comprising a lock pin which selectively engages a lock pin seat, wherein pressurized oil supplied to said lock pin causes said lock pin to retract from said lock pin seat to permit relative movement between said stator and said rotor and wherein venting oil from said lock pin allows said lock pin to engage said lock pin seat in order to prevent relative motion between said rotor and said stator at a predetermined aligned position.

18. A camshaft phaser as in claim 17 wherein said advance position and said retard position allow pressurized oil to be supplied to said lock pin.

19. A camshaft phaser as in claim 18 wherein said advance position and said retard position allow pressurized oil to be supplied to said lock pin from said phasing volume.

20. A camshaft phaser as in claim 12 wherein:

supplying oil to one of said advance chambers and said retard chambers causes oil to be vented from the other of said advance chambers and said retard chambers; and said oil is vented through said venting volume.

* * * * *